US010711351B1

(12) United States Patent
Martin et al.

(10) Patent No.: US 10,711,351 B1
(45) Date of Patent: Jul. 14, 2020

(54) ELECTROLESS PLATING COMPOSITION FOR ELECTROLESS DEPOSITION OF ALUMINUM OR ALUMINUM ALLOY AND ARTICLE INCLUDING ELECTROLESS DEPOSITED ALUMINUM LAYER

(71) Applicant: HRL LABORATORIES, LLC, Malibu, CA (US)

(72) Inventors: John H. Martin, Los Angeles, CA (US); Joanna A. Kolodziejska, Arcadia, CA (US); John J. Vajo, West Hills, CA (US); Jason A. Graetz, Calabasas, CA (US); Christopher S. Roper, Santa Monica, CA (US)

(73) Assignee: HRL Laboratories, LLC, Malibu, CA (US)

( * ) Notice: Subject to any disclaimer, the term of this patent is extended or adjusted under 35 U.S.C. 154(b) by 309 days.

(21) Appl. No.: 15/665,011

(22) Filed: Jul. 31, 2017

Related U.S. Application Data

(62) Division of application No. 14/167,733, filed on Jan. 29, 2014, now Pat. No. 9,803,283.

(60) Provisional application No. 61/893,064, filed on Oct. 18, 2013.

(51) Int. Cl.

| | |
|---|---|
| ***C23C 18/16*** | (2006.01) |
| ***C23C 18/31*** | (2006.01) |
| ***C23C 18/48*** | (2006.01) |
| ***C23C 18/52*** | (2006.01) |

(52) U.S. Cl.
CPC ..... *C23C 18/1687* (2013.01); *C23C 18/31* (2013.01)

(58) Field of Classification Search
None
See application file for complete search history.

(56) References Cited

U.S. PATENT DOCUMENTS

| | | | | |
|---|---|---|---|---|
| 2,446,331 A | | 8/1948 | Hurley | |
| 3,462,288 A | * | 8/1969 | Hellmann | C23C 16/06 427/595 |
| 3,635,761 A | * | 1/1972 | Haag | C23C 18/44 427/99.5 |
| 3,653,953 A | * | 4/1972 | Grant, Jr. | C23C 18/31 427/437 |
| 3,705,051 A | * | 12/1972 | Kobetz et al. | C03C 17/10 427/229 |
| 3,787,225 A | | 1/1974 | Roberts et al. | |

(Continued)

FOREIGN PATENT DOCUMENTS

WO WO 2012/144518 A1 10/2012

OTHER PUBLICATIONS

Koura et al., "Electroless Plating of Aluminum from a Room-Temperature Ionic Liquid Electrolyte", Journal of the Electrochemical Society, 155(2):D155-D157, 2008.

(Continued)

*Primary Examiner* — Helene Klemanski
(74) *Attorney, Agent, or Firm* — Lewis Roca Rothgerber Christie, LLP

(57) ABSTRACT

An article includes an electroless deposited aluminum layer. The aluminum layer is deposited in an electroless plating composition. The composition includes an aluminum ionic liquid, a reducing agent, and an additive selected from the group consisting of a catalyst, an alloying element, and a combination thereof.

6 Claims, 4 Drawing Sheets

(56) References Cited

U.S. PATENT DOCUMENTS 5,160,422 A * 11/1992 Nishimura ..... C23C 18/48 106/1.22
9,803,283 B1 * 10/2017 Martin ..... C23C 18/1687
10,190,227 B2 * 1/2019 Ruan ..... C23C 30/00
2005/0048210 A1 * 3/2005 Siau ..... C23C 18/31 427/372.2
2006/0062902 A1 * 3/2006 Sager ..... B22F 1/0018 427/74
2006/0251800 A1 * 11/2006 Weidman ..... B82Y 30/00 427/99.5
2008/0187675 A1 8/2008 Scarpa et al.
2009/0301894 A1 * 12/2009 Ehlers ..... C23C 18/165 205/170
2011/0311822 A1 12/2011 Hao et al.
2014/0030635 A1 1/2014 Nakada et al.
2015/0101935 A1 * 4/2015 Chen ..... C25D 17/002 205/208
2016/0054487 A1 * 2/2016 Cojocaru ..... C23C 18/31 359/845
2019/0186033 A1 * 6/2019 Ruan ..... C23C 30/00

OTHER PUBLICATIONS

Shitanda et al., "Electroless plating of aluminum using diisobutyl aluminum hydride as liquid reducing agent in room-temperature ionic liquid", Electrochima Acta 54, 5889-5893, 2009.
Tsuda et al., "Electrodeposition of Al—Zr Alloys from Lewis Acidic Aluminum Chloride-1-Ethyl-3-methylimidazolium Chloride Melt", Journal of the Electrochemical Society, 151(7):C447-C454, 2004.

* cited by examiner

EDAX ZAF Quantification (Standardless)
Element Normalized
SEC Table : Default

| Element | Wt % | At % | K-Ratio | Z | A | F |
|---|---|---|---|---|---|---|
| O K | 11.19 | 17.69 | 0.0443 | 1.0697 | 0.3694 | 1.0013 |
| AlK | 85.03 | 79.55 | 0.8064 | 0.9807 | 0.9568 | 1.0005 |
| S K | 3.09 | 2.44 | 0.0229 | 1.0055 | 0.7349 | 1.0001 |
| TiK | 0.68 | 0.36 | 0.0059 | 0.8961 | 0.8674 | 1.0000 |
| Total | 100.00 | 100.00 | | | | |

ELECTROLESS PLATING COMPOSITION FOR ELECTROLESS DEPOSITION OF ALUMINUM OR ALUMINUM ALLOY AND ARTICLE INCLUDING ELECTROLESS DEPOSITED ALUMINUM LAYER

CROSS-REFERENCE TO RELATED APPLICATIONS

This application is a divisional of U.S. application Ser. No. 14/167,733, filed on Jan. 29, 2014, now U.S. Pat. No. 9,803,283, which claims priority to and the benefit of U.S. Provisional Application No. 61/893,064, filed Oct. 18, 2013, the entire contents of both of which are incorporated herein by reference.

STATEMENT REGARDING FEDERALLY SPONSORED RESEARCH OR DEVELOPMENT

This invention was made with Government support under Contract No. W91CRB-10-C-0305 awarded by the US ARMY. The Government has certain rights in the invention.

FIELD OF THE INVENTION

The present disclosure relates to a method of electroless deposition of aluminum or aluminum alloy, an electroless plating composition, and an article including the same.

INTRODUCTION

Aluminum, due to its abundance and superior properties such as corrosion resistance, thermal and electric conductivity, or low density, has been used widely in applications such as electronics, packaging, construction, household items, toys, or transportation vehicles. In those applications, aluminum is used either as a sheet or foil that is relatively thick (e.g., about 1 cm or more), or a coating or film that is relatively thin (e.g., about 1 cm or less).

Aluminum is currently applied as a coating or thin film using methods such as aluminum cladding (a process where aluminum and another metal are bonded together by being rolled together at a suitable pressure and temperature), thermal or slurry spraying (where molten or semi-molten aluminum, or an aluminum containing slurry is sprayed onto a substrate), physical or chemical vapor deposition (where thin aluminum film is produced through condensation of a vaporized form of aluminum under high vacuum), or electrolytic deposition (also referred to as electrolytic plating, where electrical current is used to reduce dissolved aluminum cations to form an aluminum film on an electrode). However, each of the methods has some drawbacks and they are all limited to a substrate of simple geometry. For example, aluminum cladding is generally limited to flat sheets and difficult to apply to complex geometries. Thermal or slurry spraying also has limitation to the geometry of the substrate and requires line of sight for the coating to be deposited. In addition, the spraying methods tend to have non-uniformity issue and the product may contain contaminants from the process and therefore limiting the application of this method. Physical or chemical vapor deposition, on the other hand, requires expensive and specialized equipment, is conducted at a high temperature, and is only applicable to selected substrates with simple geometries. Electrolytic deposition of aluminum, when conducted in a solvent system, in addition to the drawback of using highly flammable solvents, can only be used to deposit pure aluminum. When using ionic liquid based aluminum alloy deposition, due to the low solution conductivity of aluminum or aluminum alloys, it is often difficult to plate alloy onto complex geometries, and also difficult to produce a coating of uniform thickness. In addition, this process requires very high power and unattainable for large parts. Besides, this process is only applicable to conductive substrates, and therefore, a non-conductive substrate has to be modified with a conductive layer prior to the electrolytic deposition.

Electroless deposition of aluminum has been explored in recent years. However, it is only limited to the deposition of pure aluminum coating on a glass plate or a copper sheet, and the rate of deposition is relatively slow (around 0.01 $mg/cm^3$-minute).

SUMMARY OF THE INVENTION

An aspect of an embodiment of the present invention is directed toward a method for electroless deposition of aluminum on a substrate. Another aspect of an embodiment of the present invention is directed toward an electroless plating composition and an article including electroless deposited aluminum layer.

Additional aspects will be set forth in part in the description which follows and, in part, will be apparent from the description, or may be learned by practice of the presented embodiments.

A method for electroless deposition of aluminum on a substrate may include: activating the substrate; providing an aluminum ionic liquid; adding a reducing agent and an additive to the aluminum ionic liquid to form an electroless plating composition, wherein the additive may be one selected from the group consisting of a catalyst, an alloying element, and a combination thereof; and immersing the substrate in the electroless plating composition.

The reducing agent may be selected from alkali metal hydrides, alkaline earth metal hydrides, alanate salts of alkali metal, alanate salts of alkaline earth metal, borohydride salts, hydrided alkyl-metal compounds, or a combination thereof.

The reducing agent may be lithium hydride, di-isobutyl aluminum hydride, $NaAlH_4$, $LiBH_4$ or $NaBH_4$.

The aluminum ionic liquid may include 1-ethyl-3-methylimidazolium chloride, N-alkylpyridinium halides, N-alkylimidazolium halides, N,N'-alkylimidazolium halides, N-alkylpyrazolium halides, N, N'-alkylpyrazolium halides, bis(trifluoromethylsulfonyl) amide, tris(pentafluoroethyl) trifluorophosphate, trifluoroacetate, trifluoromethylsulfonate, dicyanoamide, tricyanomethide, tetracyanoborate, tetraphenylborate, tris(trifluoromethylsulfonyl) methide, thiocyanate, or a combination thereof.

The additive may include the catalyst, and the catalyst may be selected from the group consisting of $TiCl_2$, $TiCl_3$, $TiCl_4$, $ZrCl_4$, $VCl_3$, $NbCl_5$, $CeCl_3$ and combinations thereof.

The catalyst may be included from about 2 ppm to about 1 weight percent based on a total weight of the electroless plating composition.

The activating of the substrate may include: degreasing the substrate; etching the substrate utilizing a weak acid, strong acid, weak base, or strong base; and creating catalytic metal sites on the substrate for deposition.

The creating catalytic metal sites on the substrate for deposition may include depositing iron, palladium, silver, gold, ruthenium, rhodium, osmium, iridium, platinum, or combinations thereof on the substrate.

The creating catalytic metal sites on the substrate for deposition may include depositing palladium on the substrate utilizing physical vapor deposition, chemical vapor deposition, or a solution/suspension of palladium.

The substrate may include glass, metal, metal oxide, ceramic, organic material, or polymer.

The substrate may have a complex geometry, and the aluminum layer may be uniformly deposited on the substrate.

The method may further include adding particulates in the electroless plating composition prior to the immersing the substrate in the electroless plating composition, and the aluminum layer is deposited on the substrate with the particulates.

The particulates may include MgSi, SiC, CrC, TiC, BN, BC, diamond, metal, metal alloy, or a combination thereof.

The particulates may be about 10 nm to about 100 microns in diameter.

The method may further include removing the substrate to have a free standing aluminum layer.

The removing of the substrate may be conducted utilizing solvent dissolving, chemical etching, mechanical erasing, plasma discharging, electrical discharging, or thermal decomposing.

The additive may include the alloying element.

The alloying element may be selected from B, Mg, Sc, Ti, V, Cr, Mn, Fe, Co, Ni, Cu, Zn, Si, Ga, Ge, Y, Zr, Nb, Mo, Tc, Ru, Rh, Pd, Ag, Cd, In, Sn, Sb, Hf, Ta, W, Re, Os, Jr, Pt, Au, Tl, Pb, La, Ce, Nd, Sm, Ac, Th, U, Pu, or combinations thereof.

The alloying element may be included from about 0.01 atomic percent to about 95 atomic percent of the aluminum layer.

The additive may include the catalyst and the alloying element.

An article may include an electroless deposited aluminum layer, wherein the aluminum layer may include aluminum and less than about 1 weight percent of a metal element of a catalyst based on a total weight of the aluminum layer, the catalyst being selected from the group consisting of $TiCl_2$, $TiCl_3$, $TiCl_4$, $ZrCl_4$, $VCl_3$, $NbCl_5$, $CeCl_3$ and combinations thereof.

The aluminum layer may further include particulates.

The particulates may be selected from $Mg_2Si$, SiC, CrC, TiC, BN, BC, diamond, metal, metal alloy, or a combination thereof.

The particulates may be about 10 nm to about 100 microns in diameter.

The aluminum layer may further include about 0.01 atomic percent to about 95 atomic percent of one or more alloying elements, the one or more alloying elements being selected from B, Mg, Sc, Ti, V, Cr, Mn, Fe, Co, Ni, Cu, Zn, Si, Ga, Ge, Y, Zr, Nb, Mo, Tc, Ru, Rh, Pd, Ag, Cd, In, Sn, Sb, Hf, Ta, W, Re, Os, Jr, Pt, Au, Tl, Pb, La, Ce, Nd, Sm, Ac, Th, U, Pu, or combinations thereof.

The aluminum layer may include amorphous, nanocrystalline, microcrystalline, multiphase, or mixed crystal size structure.

The aluminum layer may include a first layer of a first composition, and a second layer of a second composition different from the first composition.

The article may further include a substrate selected from glass, metal, metal oxide, ceramic, organic material, or polymer; and the aluminum layer may be uniformly deposited on the substrate.

The substrate may have a microtruss structure, or a complex shape.

A grain size of the aluminum may be less than 100 microns.

A grain size of the aluminum may be less than 10 microns.

A grain size of the aluminum may be less than 1 microns.

The aluminum layer may be less than 1 cm in thickness.

The aluminum layer may be less than 1 mm in thickness.

The aluminum layer may be less than 100 microns in thickness.

The aluminum layer may be less than 1 micron in thickness.

The article may consist essentially of the electroless deposited aluminum layer, the aluminum layer may further include about 0.01 atomic percent to about 95 atomic percent of one or more alloying elements, and the metal element of the catalyst may be included in about 2 ppm to about 1 wt % based on the total weight of the aluminum layer.

The one or more alloying elements may be selected from B, Mg, Sc, Ti, V, Cr, Mn, Fe, Co, Ni, Cu, Zn, Si, Ga, Ge, Y, Zr, Nb, Mo, Tc, Ru, Rh, Pd, Ag, Cd, In, Sn, Sb, Hf, Ta, W, Re, Os, Jr, Pt, Au, Tl, Pb, La, Ce, Nd, Sm, Ac, Th, U, Pu, or combinations thereof.

A grain size of the aluminum and/or the alloying element may be about 1 nm to about 100 nm.

The aluminum layer may further include particulates.

An electroless plating composition may include an aluminum ionic liquid; a reducing agent; and an additive selected from the group consisting of a catalyst, an alloying element, and a combination thereof.

BRIEF DESCRIPTION OF THE DRAWINGS

These and other features and advantages of the present invention will be better understood by reference to the following detailed description when considered in conjunction with the following drawings, in which.

DETAILED DESCRIPTION

Herein after, an "aluminum layer" may refer to a pure aluminum layer with less than 1 wt % of another element (such as an element of the catalyst), a layer of an aluminum-alloy, or a particulate containing aluminum or aluminum alloy layer. The term "electroless deposition" and "electroless plating" are used interchangeably. Expressions such as "at least one of," when preceding a list of elements, modify the entire list of elements and do not modify the individual elements of the list. Further, the use of "may" when describing embodiments of the present invention refers to "one or more embodiments of the present invention."

Figure 1:
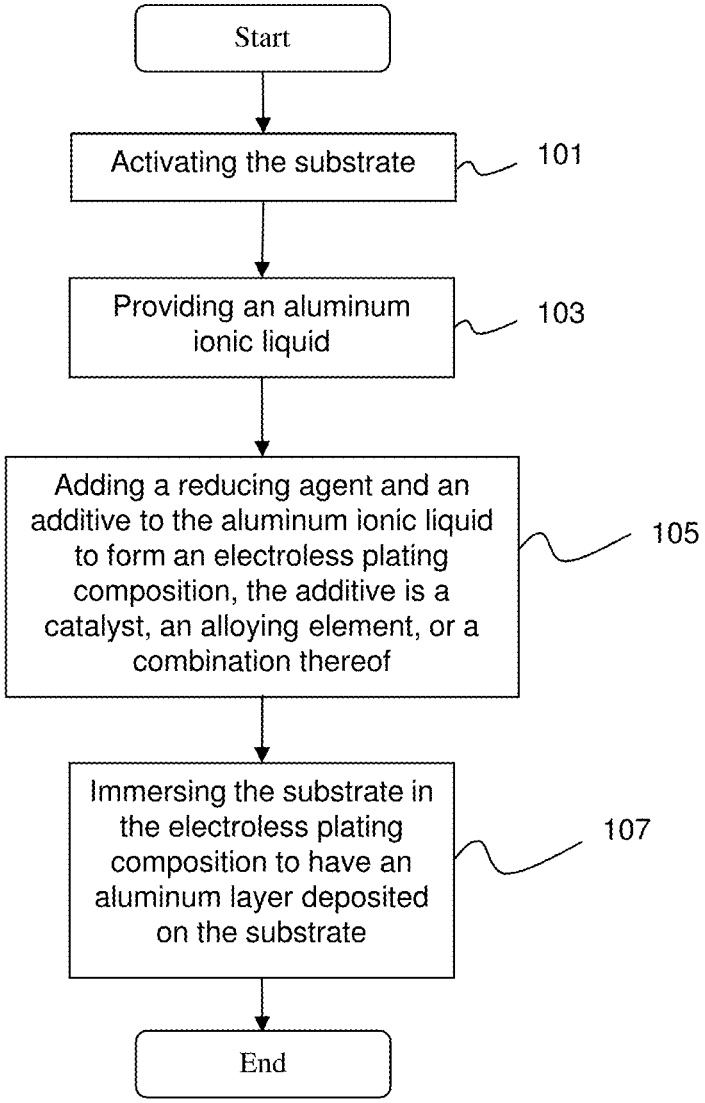
FIG. 1 is a flow chart illustrating a method of electroless deposition of aluminum accordingly to one embodiment of the present invention.

Referring to FIG. 1, a method for electroless deposition of aluminum layer on a substrate includes activating the substrate in act 101; providing an aluminum ionic liquid in act 103; adding a reducing agent and an additive to the aluminum ionic liquid to form an electroless plating composition in act 105; and immersing the substrate in the electroless plating composition to have an aluminum layer deposited on the substrate in act 107. The additive may be a catalyst, one or more alloying elements, or particulates.

The substrate to be deposited with the aluminum layer may be made of any suitable material that can withstand submersion in the ionic liquid. Examples of such suitable materials include, but not limited to, glass, metal, metal oxide, ceramic, organic material, or polymer. The substrate may have any desired geometry, including a simple geometry such a flat sheet, or a more complex geometry, such as a cube, a sphere, a pipe, or a microtruss structure. A microtruss structure is an ordered three-dimensional structure at the micrometer scale. A microtruss structure includes a plurality of first truss elements extending along a first direction; a plurality of second truss elements extending along a second direction; and a plurality of third truss elements extending along a third direction. The first, second, and third truss elements interpenetrate each other at a plurality of nodes to form a continuous material (see FIG. 2). U.S. Pat. No. 7,382,959 B1 (Optically Oriented Three-Dimensional Polymer) discloses such microtruss structures and methods of making the same, the entire content of which is incorporated herein by reference.

The activating of the substrate may include degreasing the substrate; etching the substrate utilizing a weak acid, strong acid, weak base, or strong base; and creating catalytic metal sites on the substrate for deposition, but the present invention is not limited thereto. For example, one or more of the acts may not be included in the activating of the substrate. For example, the degreasing of the substrate may not be included in the activating of the substrate.

The degreasing of the substrate may be conducted by washing the substrate in a solution of a soap, a surfactant, or a weak or a strong base solution. In one embodiment, a substrate is degreased using NaOH. By using a weak acid, a strong acid, a weak base, or a strong base, the etching of the substrate further removes any surface contaminants off the substrate, and creates desired surface morphology of the substrate. In one embodiment, a substrate is etched using 10% HCl. The creating of catalytic metal sites on the substrate for deposition may be conducted using physical vapor deposition, chemical vapor deposition, or a solution/suspension deposition of the catalytic metal. Suitable catalytic metals may be any metal that can promote metal hydride decomposition on the substrate. Examples of suitable catalytic metals include iron, or noble metals such as palladium, silver, gold, ruthenium, rhodium, osmium, iridium or platinum. In one embodiment, a polymer substrate is first etched using a base to create small holes on the polymer substrate; a colloidal suspension of palladium particles is then utilized to deposit palladium particles on the substrate, especially in the etched holes on the substrate, to create the catalytic metal sites. However, the present invention is not limited thereto. For example, the creating of catalytic metal sites on the substrate may not be included in the activating of the substrate.

The aluminum ionic liquid may include aluminum halide (such as aluminum chloride) and an ionic liquid of another salt, mixed at a suitable ratio. Suitable ionic liquids of another salt may include, but not limited to, 1-ethyl-3-methylimidazolium chloride, N-alkylpyridinium halides, N-alkylimidazolium halides, N,N'-alkylimidazolium halides, N-alkylpyrazolium halides, N,N'-alkylpyrazolium halides, bis(trifluoromethylsulfonyl) amide, trispentafluoroethyl-trifluorophosphate, trifluoroacetate, trifluoromethylsulfonate, dicyanoamide, tricyanomethide, tetracyanoborate, tetraphenylborate, tris(trifluoromethylsulfonyl) methide, thiocyanate, or a combination thereof. In one embodiment, aluminum chloride and 1-ethyl-3-methylimidazolium chloride are mixed at 2:1 molar ratio to make the aluminum ionic liquid.

The reducing agent may be any suitable compound that can give electrons to metal ions to deposit the reduced metal on the substrate. Examples of suitable reducing agent include alkali metal hydrides, alkaline earth metal hydrides, alanate salts of alkali metal, alanate salts of alkaline earth metal, borohydride salts, hydrided alkyl-metal compounds, and a combination thereof. In one embodiment, lithium hydride (LiH), $LiAlH_4$, di-isobutyl aluminum hydride (DIBAH), $NaAlH_4$, $LiBH_4$ or $NaBH_4$ is used as the reducing agent. The reducing agent may be added at a suitable amount. The amount of the reducing agent controls the electroless plating rate and the thickness of the deposit. That is, the more the reducing agent, the faster the electroless deposition, and the thicker the deposit. For example, the reducing agent may be added at a concentration of about 0.1 to about 5 M in the aluminum ionic liquid. In one embodiment, the reducing agent is added at a concentration of 0.5, 1.0, or 2.0 M in the aluminum ionic liquid.

The additive may be a catalyst, an alloying element, or a combination thereof. The additive may further include particulates. In the context according to embodiments of the present invention, a catalyst is a compound that can promote the reduction of aluminum ions and other metal elements to form a metallic deposit on the substrate when added at a small amount to the electroless plating composition. Suitable catalysts include, but not limited to, metals, metal powders, or metal salts such as $TiCl_2$, $TiCl_3$, $TiCl_4$, $ZrCl_4$, $VCl_3$, $NbCl_5$, or $CeCl_3$. The catalyst may be added at a suitable amount. In one embodiment, the catalyst is added at about 2 ppm to about 1 wt % based on the total weight of the electroless plating composition. The deposition rate and the quality of the deposited layer may be improved with the addition of the catalyst. In one embodiment, when using di-isobutyl aluminum hydride as a reducing agent without a catalytic additive, no deposition occurred on a micro-truss substrate, while the deposition proceeded quickly for the same solution when a catalytic additive was added. In another embodiment, when using LiH as a reducing agent without a catalyst, aluminum was deposited on a microtruss substrate, but did not have acceptable cohesion and the aluminum layer flaked off easily. However, when a new solution of the same composition with the addition of an catalytic additive was used for the deposition, a coherent white deposit was deposited on the microtruss.

The additive may be one or more alloying elements. An alloying element may enhance the thermal or mechanical properties of the electroless deposited aluminum-alloy (such as strength or ductility), the microstructure of electroless deposited aluminum-alloy, and the process, particularly, the rate of the electroless deposition. For example, the alloying element may lead to an autocatalytic deposition process or enhance such a process. The alloying element may lead to the formation of nanocrytalline structure rather than microcrytalline structure of the deposited layer.

The alloying elements may be any suitable metal elements that can form a corresponding metal hydride in the ionic liquid (through reaction with the reducing agent), and the corresponding metal hydride can also be decomposed to be co-deposited with aluminum on the substrate through the electroless deposition process. For example, $MgCl_2$ may be reduced by LiH through the favorable metathesis reaction $2LiH+MgCl_2=2LiCl+MgH_2$. $MgH_2$ may then be decomposed and Mg is deposited on the substrate. However, due to the higher stability of LiCl, it may not be possible to use $MgH_2$ to reduce LiCl to LiH for electroless deposition of Li. When a suitable catalyst is utilized, even a metal whose hydride that is relatively hard to be reduced may also be utilized as an alloying element to aluminum, due to the catalytic effect. For example, $TiH_4$ is highly unstable and likely to be reduced and deposited on a substrate while $TiH_2$ is generally more stable under normal conditions and may not be electroless deposited on the substrate. However, when a suitable catalyst, such as $TiCl_3$ is added to the ionic liquid, it is even possible to electrolessly deposit Ti from $TiH_2$.

Suitable alloying elements include, but not limited to, B, Mg, Sc, Ti, V, Cr, Mn, Fe, Co, Ni, Cu, Zn, Si, Ga, Ge, Y, Zr, Nb, Mo, Tc, Ru, Rh, Pd, Ag, Cd, In, Sn, Sb, Hf, Ta, W, Re, Os, Jr, Pt, Au, Tl, Pb, La, Ce, Nd, Sm, Ac, Th, U, Pu, or combinations thereof. In one embodiment, one or more alloying elements are utilized. In one embodiment, an Al—B alloy is electroless deposited on a substrate. In another embodiment, an Al—Cu—Ti—Zr alloy is electroless deposited on a substrate.

The alloying element may be added as an anhydrous metal halide salt of the alloying element or added by electrolytic dissolution of the selected metal anode into the aluminum ionic liquid. The alloying element may be included in a suitable amount according to the desired structure and property of the deposited aluminum layer. In one embodiment, one or more alloying elements are included from about 0.01 atomic fraction (at. %) to about 95 atomic percent of the deposited aluminum alloy layer, while the amount of all the elements of the deposited aluminum alloy layer adds up to 100 at. %. For example, one or more alloying elements are included from about 0.5 atomic percent to about 90 at. %, or from about 5 atomic percent to about 50 atomic percent of the deposited aluminum alloy layer.

The additive may further include particulates that are co-deposited with aluminum to form a particulate containing aluminum layer on the substrate. Suitable particulates may be about 10 nm to about 100 microns in diameter, and may enhance the mechanical property such as strength, surface roughness, surface energy, wearing, and aesthetics of the deposited particulate containing aluminum layer. Suitable particulates include, but not limited to, $Mg_2Si$, SiC, CrC, TiC, BN, BC, diamond, metal, metal alloy, or a combination thereof. The particulates may be included in a suitable amount to provide the desired improvements or enhancements of the deposited particulate containing aluminum layer. In one embodiment, particulates are included in about 0.1 wt % to about 10 wt % based on the total weight of the deposited aluminum layer including the particulates.

In one embodiment, the additive is the catalyst. In another embodiment, the additive is the one or more alloying elements. In yet another embodiment, the additive is the catalyst, the one or more alloying elements, and the particulates, each included at a suitable amount.

After the electroless plating composition is prepared, the activated substrate is immersed in the electroless plating composition. The electroless deposition of aluminum is carried out in a moisture-free and oxygen-free environment.

During deposition, bubbles may be observed around the deposited substrate, indicating gas release being part of the deposition process. Without being bound by any particular theory, it is believed that the dissolved metal ions (e.g., from aluminum halide such as aluminum chloride) get hydrogenated through an exchange reaction with the reducing agent and form an unstable intermediate metal hydride (e.g., aluminum hydride, or aluminum-metal hydride). The intermediate metal hydride such as aluminum hydride, or aluminum-metal hydride is then deposited on the substrate through the catalyzed decomposition of the metal hydride at the activated substrate surface, resulting in the deposition of metal and release of hydrogen gas. For example, the catalytic metal on the catalytic metal sites of the activated substrate may initiate the deposition of aluminum or aluminum-metal alloy by promoting initial metal hydride decomposition. The reaction then proceeds auto-catalytically on the surface of the growing film (e.g., the deposited metal promotes additional deposition of aluminum or aluminum alloys). As the formed metal hydrides decompose at the surface of the substrate, the film growth may be an epitaxial type of growth, but is not limited thereto. The catalytic additives are believed to help destabilize the metal hydrides and encourage metal hydride decomposition which results in deposition of the metal on the substrate surface and the growth of the metal film. As a result, a layer of aluminum, aluminum-alloy, or particulate containing aluminum layer is deposited on the substrate. The electroless deposition may be conducted in room temperature or at a temperature lower than 200° C. To enhance the rate of deposition and the uniformity of the deposited layer on a complex shaped substrate, agitation may be provided during the electroless deposition process. Agitation may ensure replenishment of chemistry such as reducing agent at the surfaces of the substrate being deposited.

The rate of deposition and the thickness of the layer deposited on the substrate depend on the amount of the reducing agent. The more the reducing agent added, the faster the deposition. The process continues until the desired thickness is attained, or all the reducing agent is consumed.

The structure and properties of the deposit may be altered based on the surface condition of the substrate, speed of reaction, temperature, alloying elements and other reactants involved in the deposition. For example, increasing the temperature may increase the rate of metal hydride formation and decomposition and therefore increase the plating rate. A faster plating rate may decrease the grain size of the deposit. Certain alloying elements may also decrease the grain size when co-deposited.

In one embodiment of the present invention, a plurality of aluminum layers are sequentially electroless deposited on a substrate. A first layer is deposited by immersing the activated substrate in a first electroless plating composition. After the desired amount of aluminum layer is deposited on the substrate, the substrate is removed from the first electroless plating composition and immersed in a second electroless plating composition to have a second layer deposited thereon. The first and second electroless plating compositions may be different, but are not limited thereto. In one embodiment, a first layer of pure aluminum is first deposited on a substrate, and a second layer of an aluminum alloy is then deposited on the pure aluminum layer. Additional layers may be deposited in this fashion.

Once deposition is completed for a substrate and the substrate is removed from the electroless plating composition, depleted chemicals may be added and contaminates may be removed (such as through filtering), and the electroless plating composition may be reused for deposition to other substrates. Because substrates made of different materials may be deposited using similar procedures, an electroless deposition production line may be used to electrolessly deposit an aluminum layer on different substrates.

In one embodiment of the present invention, the substrate where the aluminum layer is deposited on may be further removed to have a free standing aluminum layer. The substrate may be removed utilizing any suitable method, such as mechanical, chemical, or thermal methods. For example, the substrate may be removed through solvent dissolving, chemical etching, mechanical erasing, plasma discharging, electrical discharging, or thermal decomposing. In one embodiment of the invention, the substrate is a microtruss made of a polymer material. After an aluminum layer, an aluminum-alloy layer or a particulate containing aluminum layer has been formed on the microtruss substrate using electroless deposition, the polymer may be removed through solvent etching, and leaving a stand-alone aluminum based hollow microtruss structure. In another embodiment of the invention, the substrate is a plastic mold. The mold may be dissolved, melted, or reused after the aluminum layer has been electrolessly deposited on the mold substrate. In one embodiment, an electroless deposited layer is slipped off the mold to have a stand-alone aluminum based structure.

In yet another embodiment, the substrate is a carrier web made of a suitable material as described previously. After electroless deposition, the deposited layer is separated from the carrier web to provide a foil of pure aluminum, a foil of aluminum alloy, or a particulate containing aluminum foil. The carrier web may be reused. In one embodiment, the electroless deposition is a continuous process, with the substrate passing through multiple stations. For example, the substrate passes through a first station with a set of chemical baths to activate the substrate. The activated substrate then passes through a second station with a bath containing the electroless plating composition. The concentration of each ingredient forming the electroless plating composition, the size of the bath, and the amount of time the substrate stays in this second station may be adjusted according to the desired thickness of the deposited aluminum layer. The substrate then may pass through a third station where the deposited aluminum layer is separated from the substrate, wound into a roll, and the substrate free of the deposited layer is sent back to the first station. Reel-to-reel thin film production for pure aluminum foil, aluminum alloy foil, or particulate containing aluminum foil may be manufactured this way.

An electroless plating composition may include an aluminum ionic liquid; a reducing agent; and an additive selected from the group consisting of a catalyst, an alloying element, and a combination thereof.

An article manufactured using the method of electroless deposition of aluminum as described above may include an aluminum layer, and the aluminum layer may include aluminum and less than about 1 wt % of a metal element of a catalyst based on a total weight of the aluminum layer. The catalyst may be $TiCl_2$, $TiCl_3$, $TiCl_4$, $ZrCl_4$, $VCl_3$, $NbCl_5$, or $CeCl_3$. The aluminum layer may further include particulates, selected from MgSi, SiC, CrC, TiC, BN, BC, diamond, metal, metal alloy, or a combination thereof. The particulates may be about 10 nm to about 100 microns in diameter.

The aluminum layer may further include one or more alloying elements. For example, the aluminum layer may include B, Mg, Sc, Ti, V, Cr, Mn, Fe, Co, Ni, Cu, Zn, Si, Ga, Ge, Y, Zr, Nb, Mo, Tc, Ru, Rh, Pd, Ag, Cd, In, Sn, Sb, Hf, Ta, W, Re, Os, Ir, Pt, Au, Tl, Pb, La, Ce, Nd, Sm, Ac, Th, U, Pu, or combinations thereof. The one or more alloying elements may be included at about 0.01 atomic percent to about 95 atomic percent based on the total atoms of the aluminum layer. When one or more alloying elements are included, microstructure of the deposited aluminum layer may include amorphous, nanocrystalline, microcrystalline, multiphase, or mixed crystal size structure. A grain size of the deposited aluminum layer may be less than 100 microns, less than 10 microns, less than 1 micron, or about 1 nm to about 100 nm. A thickness of the deposited aluminum layer may be about 1 cm or less, about 1 mm or less, about 100 microns or less, or about 1 micron or less.

The alloying elements may strengthen the mechanical properties of the deposited aluminum layer. Multiple layers of aluminum or aluminum alloys may be deposited on one substrate, each having different composition, or provide a different function. For example, a layer closer to the substrate may have higher mechanical strength, while a layer closer to the free surface may have better abrasion resistance.

The method of electroless deposition of aluminum according to embodiments of the present invention may be used to create an aluminum coating or an aluminum-alloy coating on a substrate, or a free standing aluminum or aluminum-alloy structure with the substrate removed. The electroless deposited aluminum layer may form a decoration layer, a reflective coating layer (particularly suitable for complex geometries), a mirror, a wire bonding site for electrical connectors, a sacrificial corrosion resistant coating, a corrosion/wear coating (particularly suitable for complex geometries such as pipelines), or a wear resistant coating (particularly for non-conductive plastic materials). The electroless deposited aluminum layer may be further anodized or dyed. The electroless deposited aluminum layer may also be used to form electronic materials, reel-to-reel coating of materials, or a diffusion coating where a coating is first applied on the surface of a substrate, and the coating later on diffuses into the substrate, for high performance applications such as super alloys with non-line of site limitations.

The following Example is provided for illustrative purpose only, and does not limit the scope of the present invention.

Example

A 1 $cm^3$ polymer microtruss was used as a substrate for electroless plating. The polymer microtruss was activated using standard commercial solutions for the electroless deposition of metals onto plastics. This included etching followed by activation in a colloidal palladium solution. The sample was allowed to dry and then placed into an argon filled glove box with oxygen content of less than 20 ppm.

25 ml of the ionic liquid (a 2:1 molar ratio mix of aluminum chloride and 1-ethyl-3-methylimidazolium chloride, obtained commercially from Iolitec Inc.), 0.01 g of $TiCl_3$ as the catalyst and 10 ml of 1 M diisobutylaluminum hydride in Toluene as the reducing agent were mixed in a 50 ml beaker at 25° C.

Figure 2:
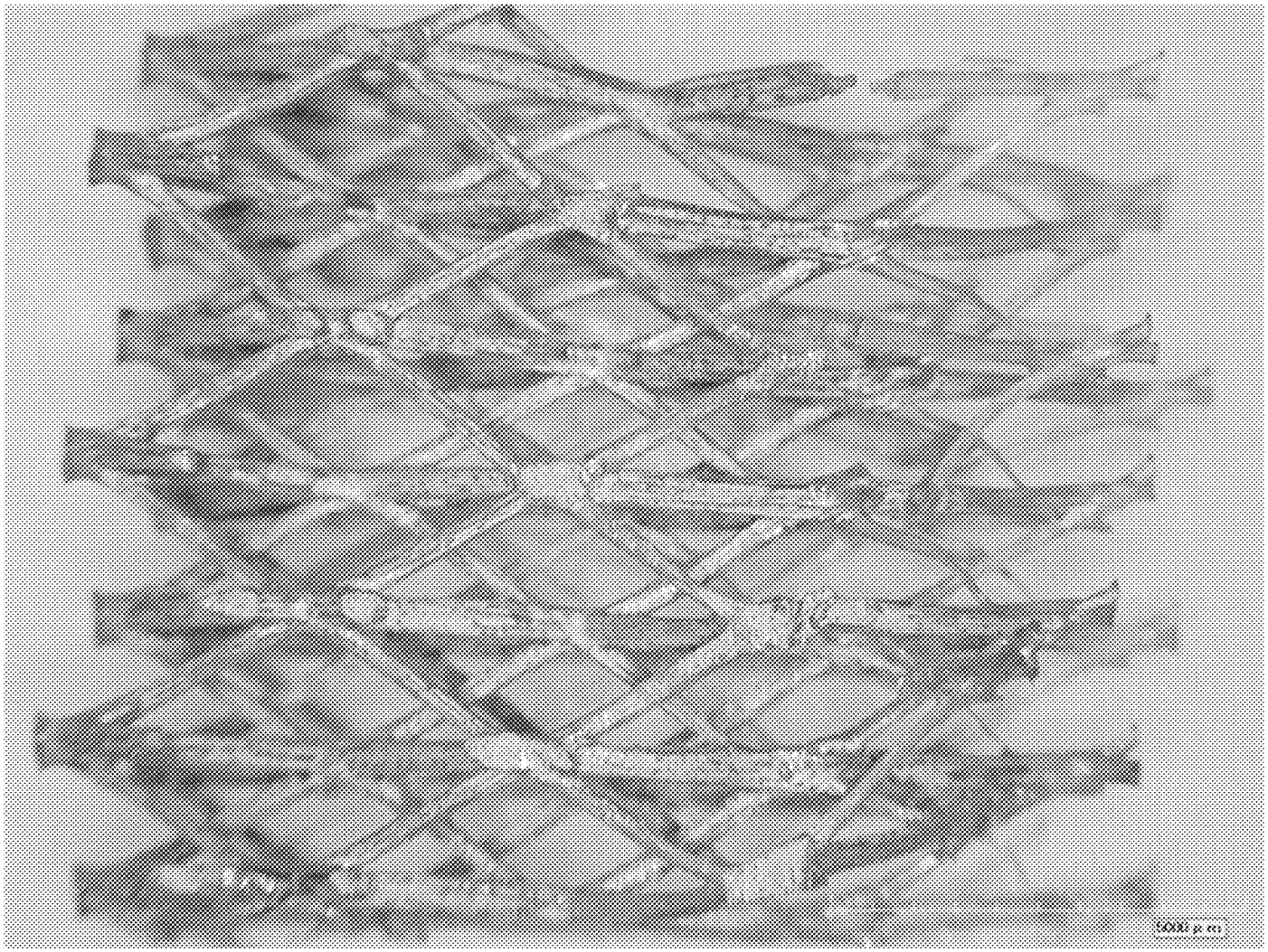
FIG. 2 is a photograph image of an electroless plated microtruss manufactured according to the process of the Example.
Figure 3:
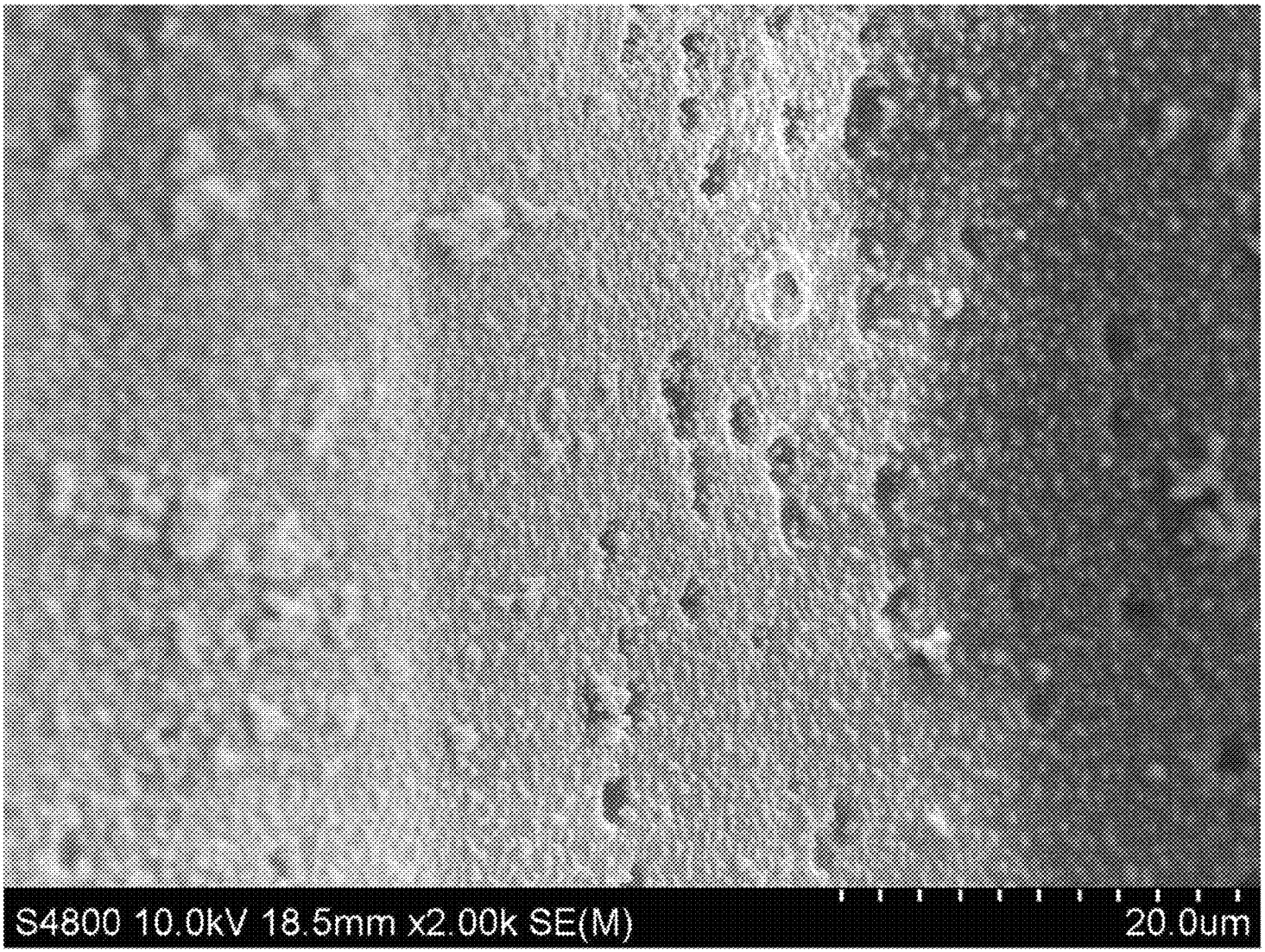
FIG. 3 is an SEM image of the aluminum layer deposited on the microtruss of FIG. 2.
Figure 4:
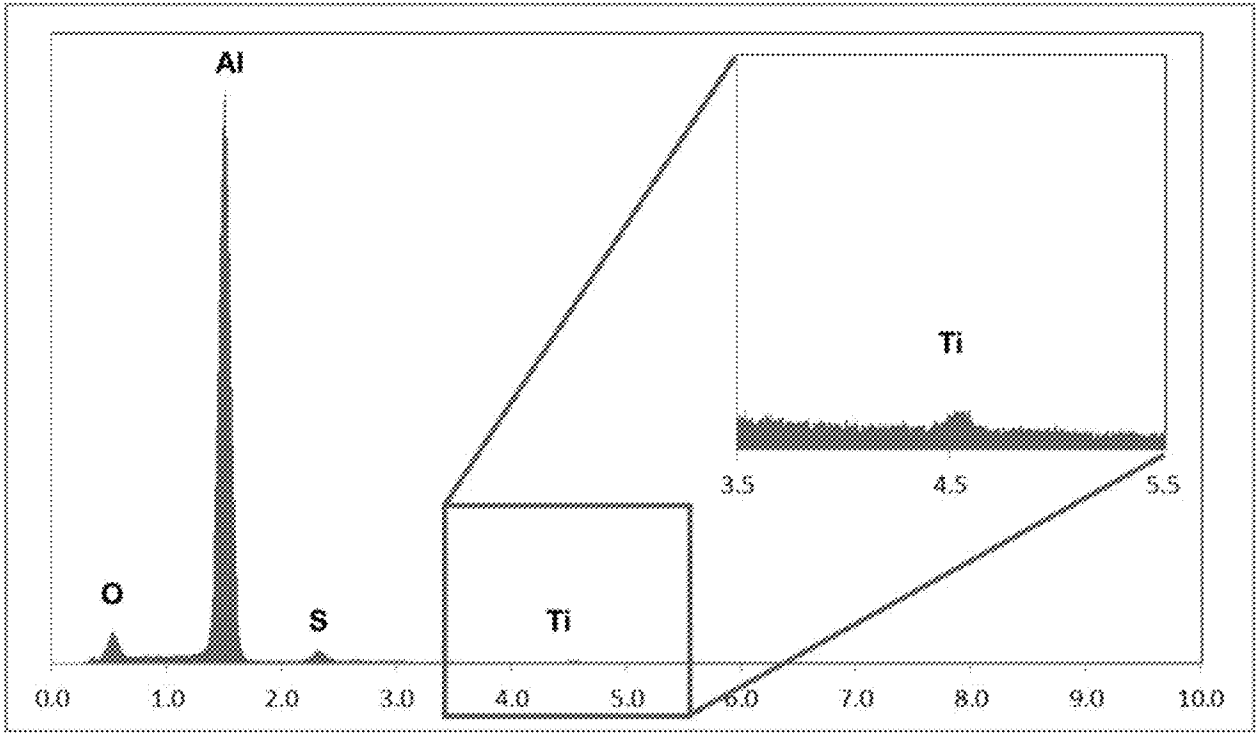
FIG. 4 is an EDS spectrum of the aluminum layer deposited on the microtruss of FIG. 2.

The activated microtruss was placed into the solution and allowed to plate for 20 min Agitation was created using a magnetic stir bar at about 200 RPM. The deposit was about 1.5 microns thick, leading to a deposition rate of about 4.5 microns/hr. The plated microtruss was then removed from the glove box and rinsed with isopropyl alcohol and water to remove any residual ionic liquid. FIG. 2 is a photograph image of the plated microtruss, FIG. 3 is an SEM image of the aluminum layer deposited on the microtruss, and FIG. 4 is an EDS spectrum of the aluminum layer deposited on the microtruss. As can be observed from FIGS. 2 and 3, the aluminum layer is deposited rather uniformly on the microstruss substrate. As can be observed from FIG. 4, the deposited aluminum layer has Al as the majority of the elements, and further includes oxygen (most likely due to the oxidation of Al on the surface), and sulfur (most likely from the underlying microtruss). The EDS spectrum also shows a trace amount of Ti, which may come from the $TiCl_3$ as the catalyst.

While certain embodiments of the present invention have been illustrated and described, it is understood by those of ordinary skill in the art that certain modifications and changes can be made to the described embodiments without departing from the spirit and scope of the present invention as defined by the following claims, and equivalents thereof.

What is claimed is:

1. An electroless plating composition, comprising:

an aluminum ionic liquid;

a reducing agent; and an additive selected from the group consisting of a catalyst, an alloying element, and a combination thereof, wherein the additive comprises the catalyst, and the catalyst is selected from the group consisting of $TiCl_2$, $TiCl_3$, $TiCl_4$, $ZrCl_4$, $VCl_3$, $NbCl_5$, $CeCl_3$ and combinations thereof.

2. The electroless plating composition of claim 1, wherein the reducing agent is selected from the group consisting of alkali metal hydrides, alkaline earth metal hydrides, alanate salts of alkali metal, alanate salts of alkaline earth metal, borohydride salts, hydrided alkyl-metal compounds, and combinations thereof.

3. The electroless plating composition of claim 1, wherein the reducing agent is lithium hydride, di-isobutyl aluminum hydride, $NaAlH_4$, $LiBH_4$ or $NaBH_4$.

4. The electroless plating composition of claim 1, wherein the aluminum ionic liquid comprises 1-ethyl-3-methylimidazolium chloride, N-alkylpyridinium halides, N-alkylimidazolium halides, N,N'-alkylimidazolium halides, N-alkylpyrazolium halides, N,N'-alkylpyrazolium halides, bis(trifluoromethylsulfonyl) amide, tris(pentafluoroethyl) trifluorophosphate, trifluoroacetate, trifluoromethylsulfonate, dicyanoamide, tricyanomethide, tetracyanoborate, tetraphenylborate, tris(trifluoromethylsulfonyl) methide, thiocyanate, or a combination thereof.

5. The electroless plating composition of claim 1, further comprising particulates about 10 nm to about 100 microns in diameter and/or selected from MgSi, SiC, CrC, TiC, BN, BC, diamond, metal, metal alloy, and combinations thereof.

6. The electroless plating composition of claim 1, wherein the additive further comprises the alloying element.

* * * * *